United States Patent [19]

Heino

[11] 4,349,056

[45] Sep. 14, 1982

[54] CONTAINER FOR LIQUID WITH NON-DRIP MEASURING CAP CLOSURE

[75] Inventor: Jørgen Heinø, Bruxelles, Belgium

[73] Assignee: The Procter & Gamble Company, Cincinnati, Ohio

[21] Appl. No.: 219,419

[22] Filed: Dec. 22, 1980

[30] Foreign Application Priority Data

Dec. 29, 1979 [GB] United Kingdom ..... 7944581

[51] Int. Cl.[3] ..... B65B 3/00

[52] U.S. Cl. ..... 141/381; 215/31; 215/228; 215/DIG. 7

[58] Field of Search ..... 215/228, 100 R, DIG. 7, 215/31, 230, 365; 141/381

[56] References Cited

U.S. PATENT DOCUMENTS

| | | | |
|---|---|---|---|
| 1,986,741 | 1/1935 | Moser | 215/DIG. 7 |
| 2,051,310 | 8/1936 | Millard | 215/31 |
| 2,056,171 | 10/1936 | Deschner | 215/31 |
| 2,221,527 | 11/1940 | Schick | 215/31 X |
| 2,364,678 | 12/1944 | White | 215/31 X |
| 2,842,167 | 7/1958 | Tupper | 141/381 |
| 3,335,891 | 8/1967 | Bailey | 215/31 |

FOREIGN PATENT DOCUMENTS

| | | | |
|---|---|---|---|
| 1021593 | 12/1952 | France | 215/228 |

*Primary Examiner*—Donald F. Norton

[57] ABSTRACT

Combination of a container with a measuring cap closure, whereby the container neck is equipped with a peripheral end lip made of a resilient material, and which scrapes along the inner wall of the cap when it is applied to close the container, thereby causing any product residue left in the cap to run back into the container.

1 Claim, 7 Drawing Figures

CONTAINER FOR LIQUID WITH NON-DRIP MEASURING CAP CLOSURE

This invention relates to a combination of a container with a measuring cap closure whereby, when the cap is applied on the container neck for closing after it has been used to measure a quantity of the product held in the container, any product residue left in the cap is caused to run back into the container, thus avoiding drips running down the outside of the container body.

For many liquids used in the household, and more particularly for liquid detergents and fabric softeners, it is desirable for the housewife to be able to measure the exact quantity she needs for one use with a measuring device which is at hand. A good solution is when the cap, used to close the container, can also serve as measuring device. This is in general use but the disadvantage of many container/measuring cap closure combinations found on the market, is that product residue is left in the cap and runs over the container body when the cap is put back in place, thereby rendering the container unsightly and frequently sticky. Some housewives resort to the solution of rinsing and drying the measuring cap closure before applying it on the container, but this is inconvenient.

Some measuring cap closures available on the market try to overcome the problem by having a double-wall cap, whereby the space within the inner wall is to serve as measuring beaker and fits into the container neck when the cap is put back on the container, whereas the outer wall screws over the outside of the container neck and serves to keep the closure into place. There are several disadvantages to such a cap. It is not always easy to pour product inside the inner walls only; such caps are rather expensive to make; and they are cumbersome to put in place on the packing line.

Accordingly, the chief object of the present invention is to provide an improved container/measuring cap closure combination whereby the cap can be used to measure out liquid from the container and subsequently used to close the container without residual liquid dripping down the outside of the container.

Another important object of the present invention is to provide such a combination container/measuring cap closure which is easy to assemble during the packing operation.

According to the present invention, there is provided a container with a neck and a measuring cap closure, wherein the container comprises a body, a shoulder portion and neck, which neck is provided with a peripheral flange so dimensioned as to scrape along the inside wall of the cap as the cap is applied to close the container.

In a preferred embodiment of the invention, the container neck is equipped with an insert with a peripheral end lip made of a resilient material, which end lip has a diameter larger than that of the container neck and is so dimensioned as to scrape along the inner wall of the measuring cap closure when it is applied to close the container. This end lip made of resilient material has furthermore the additional advantage that it will enhance the tight sealing of the bottle.

Clearly, the peripheral flange must scrape along the portion of the inside wall of the cap adjacent the cap opening.

In another preferred embodiment of the invention, the container neck is provided with an extension made of a resilient material, which extension snaps over the end of the container neck and is provided with a peripheral flange so dimensioned as to scrape along the inside wall of the measuring cap closure as it is applied to close the container.

Preferably, fastening means are provided for securing the cap to the container. One possibility is to use a pilfer-proof attaching device on the base of the container neck. Another possibility is to arrange a screw fastening means in such a position that it does not interfere with the scraping action of the peripheral flange. For example, the inside of the container neck or insert can be equipped with a screw thread and the measuring cap closure is equipped with an inside skirt having an interengaging screw thread on its outer surface.

In order that the invention can be more readily understood, it will be described with reference to the accompanying drawings, in which.

Figure 1:
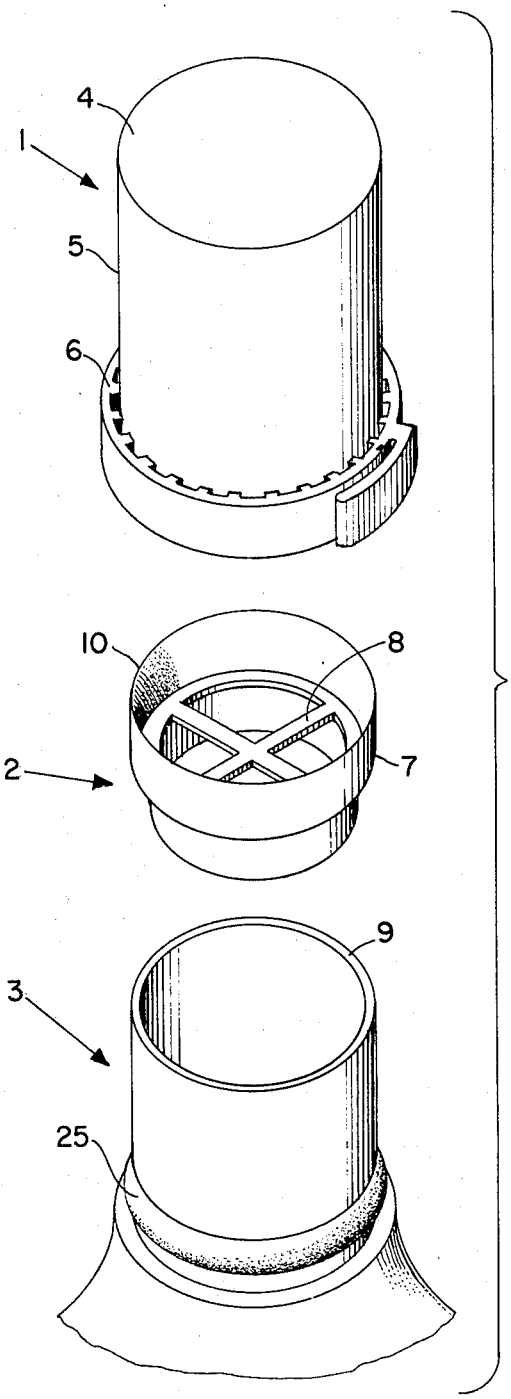
FIG. 1 is an exploded perspective view of a combination of container with neck, insert and measuring cap closure according to a preferred embodiment of the invention.

Referring to FIG. 1, there is shown the top part of a container with neck 3, a neck insert 2 of resilient material and a measuring cap closure 1. The container neck 3 receives the insert 2 before measuring cap closure 1 is put in place to close the container. The insert 2 is equipped with a lip 7 which, when the insert 2 is engaged in container-neck 3, contacts the rim 9 of the container neck 3. The insert 2 also includes a cross-bar 8 which assists the dispensing of liquids.

Figure 2:
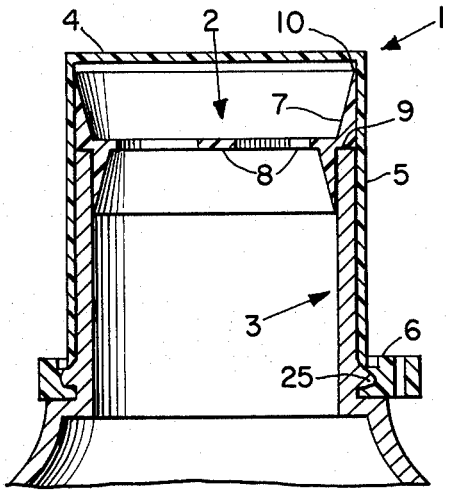
FIG. 2 is a cross-section of the combination of FIG. 1, in closed and sealed position.

The measuring cap closure 1 consists of a closed end portion 4 and a generally cylindrical skirt portion 5. A pilfer-proof seal 6 is attached to the circular free edge of the skirt 5 and serves to secure the cap on the container. As best seen in FIG. 2, the pilfer-proof seal 6 engages over an annular protrusion 25 on the container neck.

Figure 3:
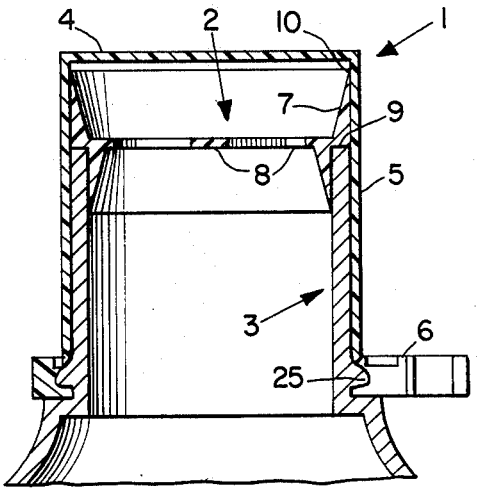
FIG. 3 is a cross-section of the combination of FIG. 2, when first opened by the user.
Figure 4:
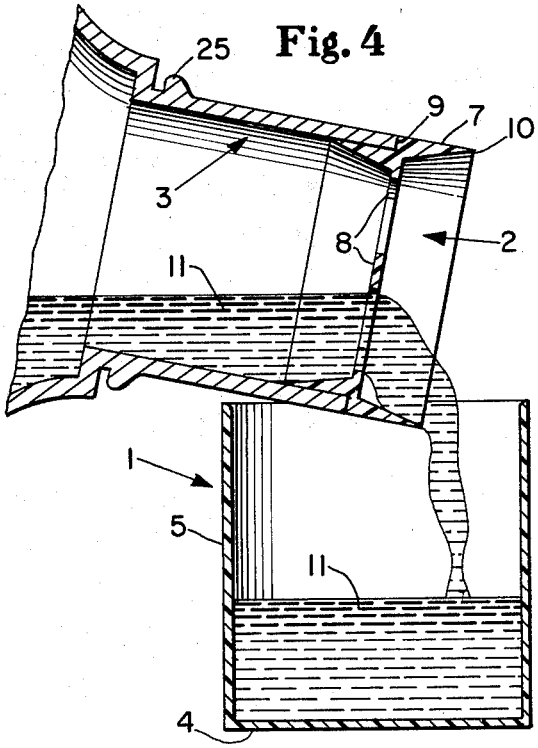
FIG. 4 is a cross-section of the embodiment of FIG. 2, with the cap used in its measuring function.

As seen in FIG. 3, as the pilfer-proof seal 6 is removed, the cap 1 becomes free to be removed from the neck of the container and can be used as a measuring device (see FIG. 4).

Figure 5:
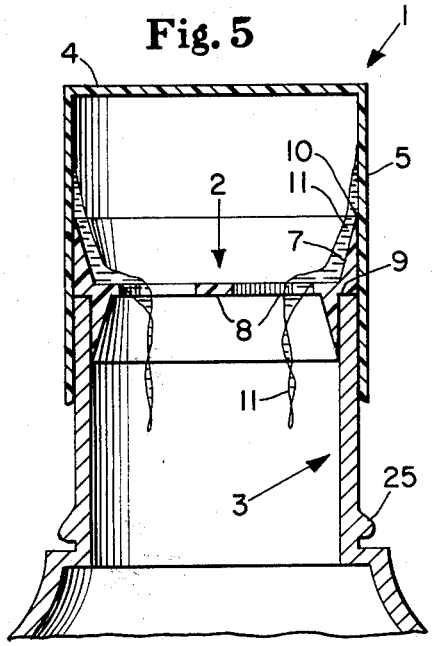
FIG. 5 is a cross-section of the embodiment of FIG. 2 in partially closed position.

As indicated in FIG. 5, to close the container cap 1 is applied over the neck 3 and edge 10 of the lip 7 of the insert 2 scrapes along the inside wall of the cap skirt 5, so that product 11 runs back into the container neck 3, thereby preventing dripping of product over the outside of container neck and body.

Figure 6:
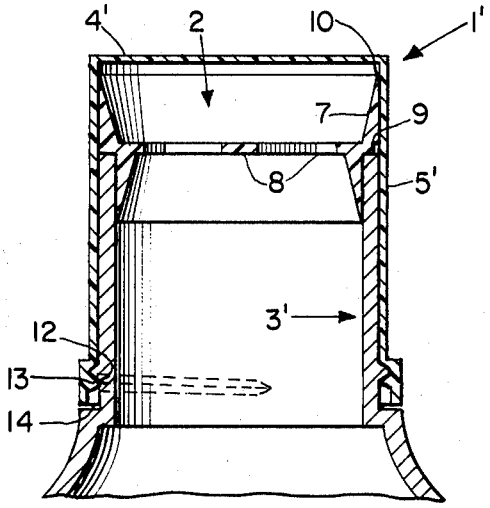
FIG. 6 is a cross-section of another embodiment of the invention, wherein the cap is fastened onto the neck by a partial screw thread.

Referring now to FIG. 6, there is shown another preferred embodiment which includes all the features described above, with the exception of the pilfer-proof seal 6, which is replaced by a partial screw-thread 12 on the base of the container neck 3' and a partial screw-thread 13 on the inside of the free end 14 of cap skirt 5', to allow a 90° screwing-on of the cap 1' over the container neck 3'.

Figure 7:
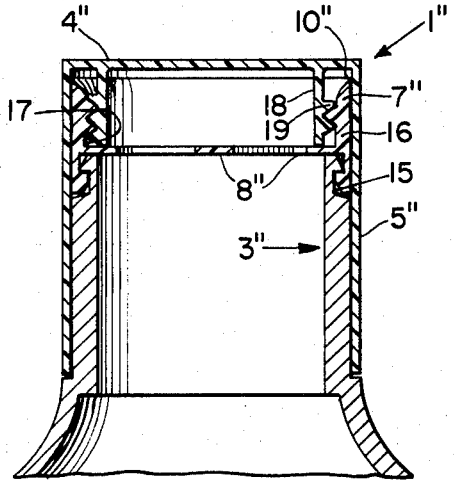
FIG. 7 is a cross-section of another embodiment of the invention, the cap being equipped with a screw thread.

FIG. 7 shows another embodiment of the invention, wherein container neck 3'' has a circular groove 15 in its outside wall, into which groove a neck extension 16 snaps. The inside wall of the part of the neck extension 16 which extends above the container neck 3'' is provided with a screw thread 17. Cap 1'' is equipped with an internal circular skirt 18 parallel to the cap skirt 5'' and provided with a screw thread 19 to interengage with the screw thread 17 on the neck extension 16. Neck extension 16 is equipped (as in the above-described embodiments) with a lip 7'' having a circular free edge 10'' and a cross-bar 8''.

The operation of the drip free measuring cap of the present invention is as follows.

As the cap 1 is applied to the container neck 3, the inside surface of the skirt 5 is scraped by the circular free edge 10 of the lip 7 of either the insert 2 or the neck extension 16, thereby forcing any residual product to run back into the container between the cross-bar 8.

What is claimed is:

1. A container for liquid with a non-drip measuring cap closure, said container comprising a neck integral with the container body, a measuring cap closure with a closed end portion and a non-perforated skirt portion, an insert received in said neck having a peripheral resilient flange in the form of an end lip so dimensioned as to scrape residual liquid from the inner wall of the skirt portion as the cap is applied to the container after it has been used for measuring so that residual liquid is caused to run back into the container and does not drip down the outside of the container, said insert including downwardly protruding means to engage the container neck and cross-bar means to assist in dispensing liquid and between which scraped residual liquid flows back into the container.

* * * * *